US008161789B2

(12) United States Patent
Battenfeld et al.

(10) Patent No.: US 8,161,789 B2
(45) Date of Patent: Apr. 24, 2012

(54) CRIMPING PLIERS COMPRISING A LOCATOR

(75) Inventors: Kurt Battenfeld, Ebsdorfergrund (DE); Thomas Glockseisen, Düsseldorf (DE)

(73) Assignee: Wezag GmbH Werkzeugfabrik, Stadtallendorf (DE)

( * ) Notice: Subject to any disclaimer, the term of this patent is extended or adjusted under 35 U.S.C. 154(b) by 297 days.

(21) Appl. No.: 12/408,069

(22) Filed: Mar. 20, 2009

(65) Prior Publication Data

US 2009/0249855 A1 Oct. 8, 2009

(30) Foreign Application Priority Data

Apr. 4, 2008 (DE) ..... 10 2008 017 366

(51) Int. Cl.
*B21F 15/00* (2006.01)

(52) U.S. Cl. ..... 72/409.14; 72/409.07; 72/409.13

(58) Field of Classification Search ..... 409/130; 72/409.01, 409.07, 409.08, 409.11, 409.13, 72/409.14, 409.16; 81/300
See application file for complete search history.

(56) References Cited

U.S. PATENT DOCUMENTS

| | | | | |
|---|---|---|---|---|
| 3,393,438 A | | 7/1968 | Marley et al. | |
| 4,381,661 A | * | 5/1983 | Wiener et al. | 72/409.12 |
| 4,590,786 A | * | 5/1986 | Wiener et al. | 72/409.12 |
| 6,155,095 A | * | 12/2000 | Beetz | 72/409.14 |

FOREIGN PATENT DOCUMENTS

| | | | |
|---|---|---|---|
| DE | 27 18 165 | A1 | 10/1978 |
| DE | 38 25 775 | A1 | 5/1989 |
| DE | 198 32 884 | C1 | 12/1999 |
| EP | 0 368 825 | A2 | 10/1989 |

OTHER PUBLICATIONS

European Search Report in co-pending, related EP Application No. 09155540.9, mailed Apr. 13, 2011.

First Examination Report in related, co-pending German Patent Application No. 10 2008 017 366.5, dated Apr. 29, 2009.

* cited by examiner

*Primary Examiner* — Edward Tolan
*Assistant Examiner* — Homer Boyer
(74) *Attorney, Agent, or Firm* — Thomas, Kayden, Horstemeyer & Risley, LLP

(57) ABSTRACT

The present invention relates to crimping pliers for crimping a work piece. The crimping pliers comprise two hand levers. The hand levers are linked with tools or dies for applying a crimping movement upon the work piece. The dies are housed in a head of the crimping pliers. A locator has a pivoting degree of freedom with respect to the head around a pivoting axis which has an orientation parallel to a main extensional plane of said head and transverse to the degree of freedom of the dies during the crimping process. The locator comprises an activating element with an extension being designed and arranged such that said extension is located in the access area of a finger of a hand of a user of said pliers gripping or contacting the hand levers.

8 Claims, 12 Drawing Sheets

CRIMPING PLIERS COMPRISING A LOCATOR

CROSS REFERENCE TO RELATED APPLICATION

This application claims priority to co-pending German Patent Application No. DE 10 2008 017 366.5 entitled "Presszange mit einem Positionierer", filed Apr. 4, 2008.

FIELD OF THE INVENTION

The present invention generally relates to crimping pliers comprising a locator or positioner for positioning the work piece. The crimping pliers are used for manually pressing or crimping a work piece.

BACKGROUND OF THE INVENTION

Crimping pliers are used for pressing or crimping a work piece in a tool or die located in a head of the crimping pliers. Such crimping pliers might be used for crimping a connector or electrical contact with an end of an electric wire, wherein an insulation might be removed from the end of the electrical wire before crimping the connector or contact upon the end. The crimping pliers might also be used as working pliers for causing a plastic deformation of the work piece, for cutting or separating parts of the work piece or for punching or stamping the work piece.

Furthermore, it is known to equip crimping pliers with a locator. The locator is used for positioning the work piece relative to the head of the pliers and relative to the tool or dies. The locator guarantees the exact position of the work piece at the start of the crimping process. For one known embodiment, the locator guarantees the correct position of a connector or fitting relative to the wire end freed from the insulation. Furthermore, the locator might interact with the work piece during the crimping process. A locator might also be useful for using the crimping pliers for small work pieces. This is due to the fact that the manual positioning of a small work piece through an opening of the head of the pliers into the tool or die might be difficult or unsuitable for reaching a desired position with a desired small tolerance. When using the crimping pliers for connecting a connector, contact or fitting with a wire end, it has to be guaranteed at the start of the crimping process that both the connector and the wire end have a predetermined relative position to the tool or dies.

The prior art discloses a lot of different embodiments of crimping pliers, transfer mechanisms, kinematics with different degrees of freedom for the components of the crimping pliers moved throughout the crimping process as well as embodiments for locators. All of these known embodiments might be improved by the present invention:

Crimping pliers known from German Patent Application No. DE 27 18 165 A1 have a C-shaped head which is open in lateral direction. Another embodiment of DE 27 18 165 A1 shows dies or tools being moved similar to scissors. For both aforementioned embodiments, the head of the pliers extends in a plane. The pliers have a locator which is pivotable around a pivoting axis between a position for assembly and a working position. The locator comprises a nest for accommodating a work piece. The pivoting axis has an orientation perpendicular to the plane of the head. It is possible to pivot the locator into the position for assembly, introduce the work piece into the nest and pivot the locator with the work piece pinned into or housed by the nest through an open side of the head into a working position. In the working position, the work piece has a defined relative position to the tools or dies. Subsequently, the crimping process plastically deforming the work piece is continued by driving the crimping pliers, here by manually pivoting the hand levers.

Another crimping pliers is distributed by the applicant of the present patent application with the label CS20KS, see FIG. 1. The crimping pliers comprise a C-shaped head being open in one lateral direction. The head comprises a locator having a linear degree of freedom along a shaft fixed at the head, wherein the shaft follows the horizontal leg of the C. Furthermore, the shaft has an orientation parallel to the plane of the head of the pliers. The locator is driven by a lever pivotably linked with the head of the pliers. The pivoting movement of the lever is transferred by a connection between a pin guided in an elongated hole into a linear movement along the shaft.

Furthermore, crimping pliers distributed by the applicant of the present patent application under the label CS25KS (see FIG. 2) comprise a C-shaped head. Here, a locator is pivotably linked with the head having a pivoting axis with an orientation perpendicular to the plane of the head. A pivoting movement of the locator is caused by manually rotating a knurled disc for transferring the locator from a position for assembly to a working position. As shown in FIG. 2, a pivoting movement of the locator requires a manipulation of the crimping pliers with both hands of the user, wherein one hand of the user grips the crimping pliers at the hand levers, whereas the other hand of the user causes the pivoting movement of the locator.

German Patent No. DE 198 32 884 C1 corresponding to U.S. Pat. No. 6,155,095 discloses crimping pliers having a head built with metal plates. Here, the head is O-shaped without an opening in one lateral direction. Caused by an activation of hand levers a movable part or die is moved along a longitudinal axis of the crimping pliers relative to a fixed part of the tool or die. The document discloses a locator being pivoted around a pivoting axis which has an orientation parallel to the plane of the head of the pliers and transverse to the direction of movement of the parts of the tool or dies of the crimping pliers. In a working position, the locator has an orientation parallel to the plane of the head. The locator is pivoted around the pivoting axis from a working position into a position for assembly. The activation of a pivoting movement of the locator requires both hands of a user of the crimping pliers.

SUMMARY OF THE INVENTION

The present invention relates to a locator having a pivoting degree of freedom with respect to the head of the pliers around a pivoting axis. The pivoting axis has an orientation parallel to the plane, wherein the head of the pliers mainly extends. Furthermore, the pivoting axis has an extension transverse to the relative degree of freedom of parts of the tool or the dies of the crimping pliers. Accordingly, it is possible to pivot the locator "away" from the plane of the head of the crimping pliers.

The inventive design might be used for C-shaped heads as described above. However, the aforementioned degree of freedom of the locator is also useful for heads of crimping pliers having other shapes than C-shapes. This is due to the fact that it is not necessary to move the locator through the opening of the C as known from DE 27 18 165 A1 and the crimping pliers of the applicant distributed under the labels CS20KS and CS25KS.

For the inventive crimping pliers, the locator is linked with an activating element that directly or indirectly causes the pivoting movement of the locator relative to the head by manual manipulation by the user. The activating element has a design and orientation such that it is possible to manipulate the activating element by the hand of a user that, at the same, time grips or contacts the hand levers. Accordingly, the inventive crimping pliers might be manipulated by one single hand of the user. This is in particular of advantage in cases of another hand of the user being needed for holding the or another work piece and introducing the or another work piece into the crimping pliers.

Also the crimping pliers of the applicant distributed under the label CS20KS could be manipulated by one single hand with the thumb of the user causing the movement of the locator. However, the path of the thumb for causing a movement of the locator for this known prior art increases with a closing movement of the hand levers. Instead, according to the invention, the pivoting axis has another orientation leading to a different degree of freedom of the locator. The inventive orientation leads to the result that the path of a finger of the user for activating the activating element is less dependent or independent on the relative position of the hand levers. Furthermore, it might be possible to activate the activating element by an index finger which is not possible for the crimping pliers CS20KS.

Furthermore, the crimping pliers CS20KS require a complex activating mechanism with a pivotable lever and a transmission system for converting the pivoting movement into a linear movement.

According to another embodiment of the invention, the activating element is built with an arm or extension of the locator, wherein such arm or extension might have a simple design. The dimensions of the arm, in particular the length of the arm, and the contour of the arm might be adapted for providing good haptics and a good accessibility of the activating element.

According to one example, the arm might be built by a metal sheet, wherein such metal sheet might be curved, cranked, twisted for providing a desired geometry and activating surfaces for a finger of the hand of the user.

According to another embodiment of the invention, the arm has a multifunctional design. For this embodiment, the arm is firstly used for applying a force or moment for pivoting the locator. Furthermore, the arm serves as a support for a spring element, wherein the spring element might serve for biasing the locator versus a position, in particular the working position.

For another embodiment of the invention, the hand levers are moved in a plane during the crimping process, wherein the aforementioned plane might be the plane of the head or parallel to the plane of the head. In the working position of the locator, the arm has an angle smaller than 90° with respect to the aforementioned plane. For transferring the locator from the working position into another position, in particular the position for assembly, the arm is pivoted versus the plane of the head of the pliers or the plane, wherein the hand levers are moved. Such pivoting movement might be caused by the index finger or the middle finger of a hand that contacts or grips the crimping pliers.

For another embodiment of the invention, the locator is secured in the working position by a resting unit, locking unit or latching mechanism.

In this context, a resting unit describes a unit building a stable equilibrium for the working position. Accordingly, the resting unit keeps or restores the locator in the working position for small forces acting upon the locator or the arm. Instead, for larger forces acting upon the arm or the locator, the locator might be moved away from the working position. Examples of suitable resting units are spring biased resting elements that engage a resting groove in the working position. The dimensioning of the force level secured by the resting unit might be done by the choice of the diameter of the resting sphere, the geometry of the contour of the resting groove and/or the stiffness of a spring supporting the resting sphere. However, it is also possible to use a resting pin instead of the resting sphere. Furthermore, it might be useful to use a permanent magnet as a part of the resting unit, wherein the force of the permanent magnet determines the resting force in the working position.

Instead, in the present context, a locking unit is a unit that secures the working position so that it is not possible to move the locator out of the working position solely by applying forces in the direction of the pivoting degree of freedom. A locking unit secures the working position (with or without play) by positive locking, e.g., by use of a locking bolt or a pawl. It is possible to release the locking unit with the hand holding the crimping pliers or with the other hand of the user.

The present invention also covers embodiments wherein the locator is secured in another position than the working position, e.g., the position for assembly, by means of a resting unit or a locking unit.

The pivoting angle of the locator relative to the head of the crimping pliers might be limited by the joint of the locator at the head or a stop element. Furthermore, it is possible that the pivoting angle might be limited by the arm or extension so that the arm has another function additional to the function of transferring activation forces and/or supporting the spring element.

For one embodiment, the arm or extension is designed and arranged such that the pivoting angle is limited by the arm or extension abutting another component of the crimping pliers.

According to another embodiment of the crimping pliers, the activating element, in particular the arm or extension, is designed and arranged such that it is possible to activate the activating element when gripping the hand levers with the right hand of the user with a finger of the right hand of the user. Furthermore, for the same crimping pliers it is possible to grip the hand levers with the left hand of a user and activate the activating element with a finger of the left hand. Crimping pliers according to this embodiment might be used by a left-hander or right-hander or by the same user in different work areas. Another embodiment of the invention suggests providing a modular locator for the crimping pliers. The locator and/or the arm or extension might build a variant that is optionally combined with other components of the crimping pliers. Accordingly, it is possible to manufacture, distribute and use crimping pliers related to a first group of crimping pliers having no locators, arms or extensions. Crimping pliers related to a second group are equipped with the additional module with the locator, arm and/or extension, so that the crimping pliers related to the second group might be used with an increased comfort. However, it is also possible that existing crimping pliers having no locator are adapted or subsequently equipped with a locator or an activating element.

The locator with the pivoting axis having the mentioned orientation might be used for crimping pliers having a C-shaped open head or a ring-shaped closed head as described. The inventive features might additionally be used irrespective on

- the type of drive of the crimping pliers used,
- the type of activating mechanics and kinematics and
- the type of movement of the parts of the tool or dies relative to each other.

Instead, according to the invention the proposed positioner is suitable for any type of crimping pliers. It is also possible to transfer one and the same locator from first crimping pliers to second crimping pliers dependent on the needs of the user.

Furthermore, caused by the chosen orientation of the pivoting axis, it is also possible to design the locator independent on the number and positions of the nests or dies at the head of the crimping pliers.

Furthermore, it is possible to increase the number of the nests or dies that might be used in connection with a locator. The number of nests or dies might correlate with the number of nests for the work piece at the locator.

Another possible advantage of the inventive locator is that the locator comprises an increased accessibility in the position for assembly so that the preparation and the use of the crimping pliers is eased. The invention could also be used for crimping pliers wherein the movable part of the tool or die is guided on a linear path or a curved or circular path in the head of the crimping pliers.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
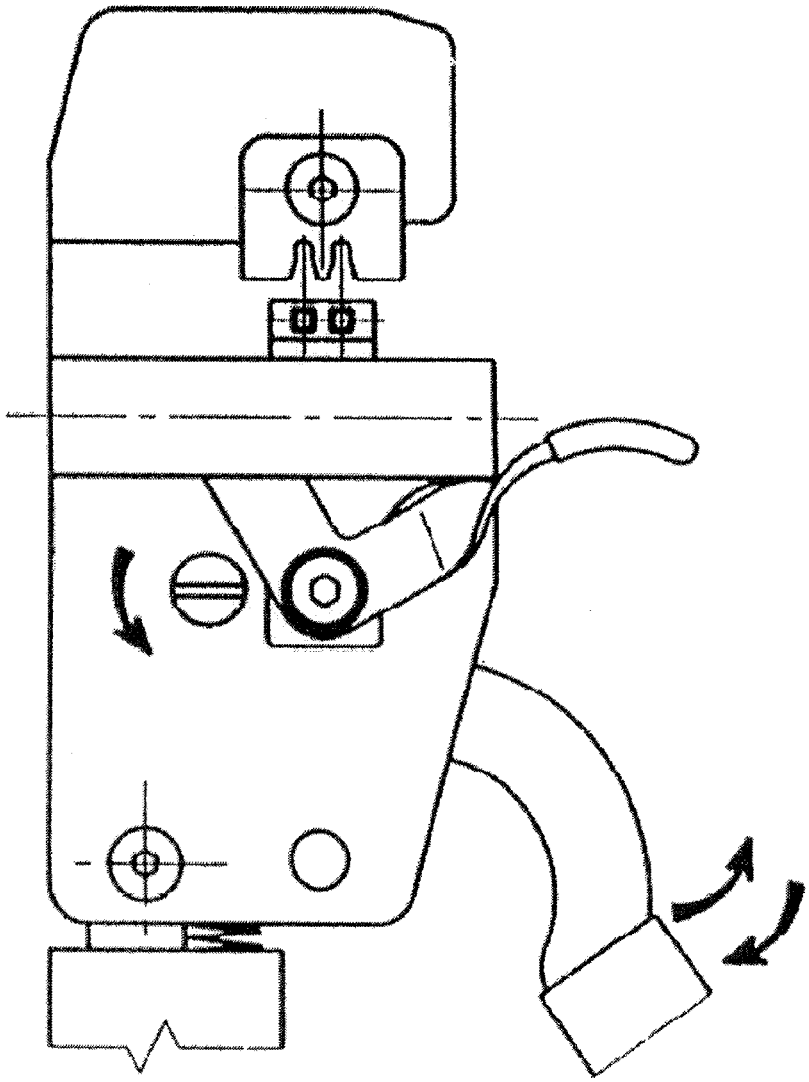
PRIOR ART Fig. 1
FIG. 1 shows a head of crimping pliers distributed by the applicant of the present patent application in Germany under the label CS20KS.
Figure 2:
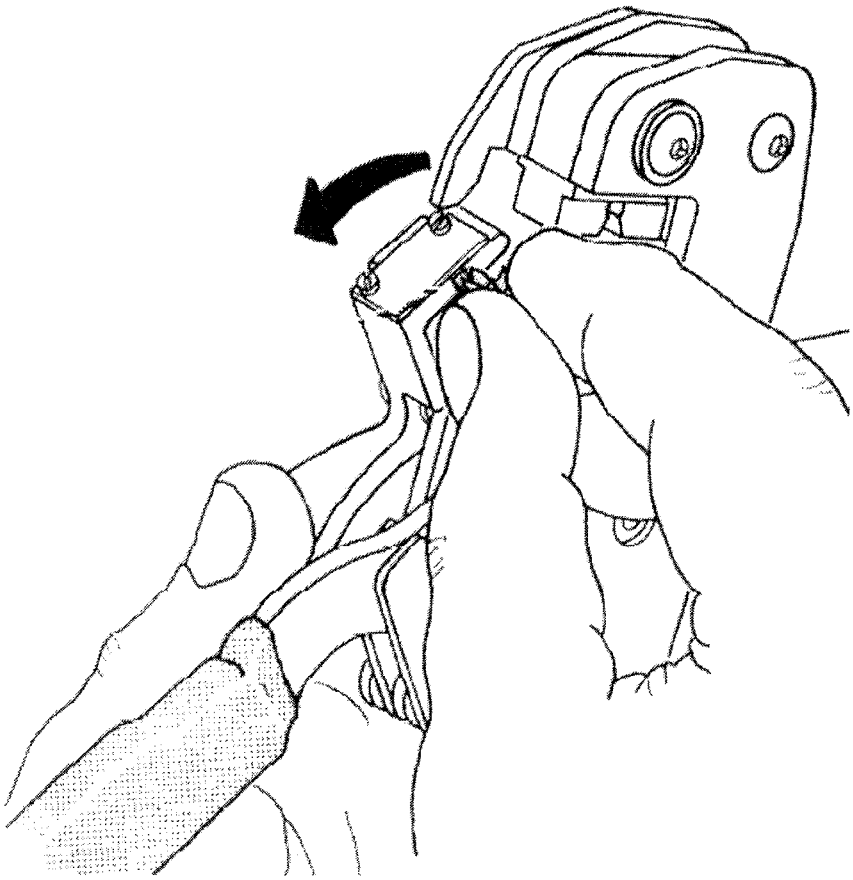
PRIOR ART Fig. 2
FIG. 2 shows a head of other crimping pliers distributed by the applicant of the present patent application in Germany under the label CS25KS.
Figure 3:
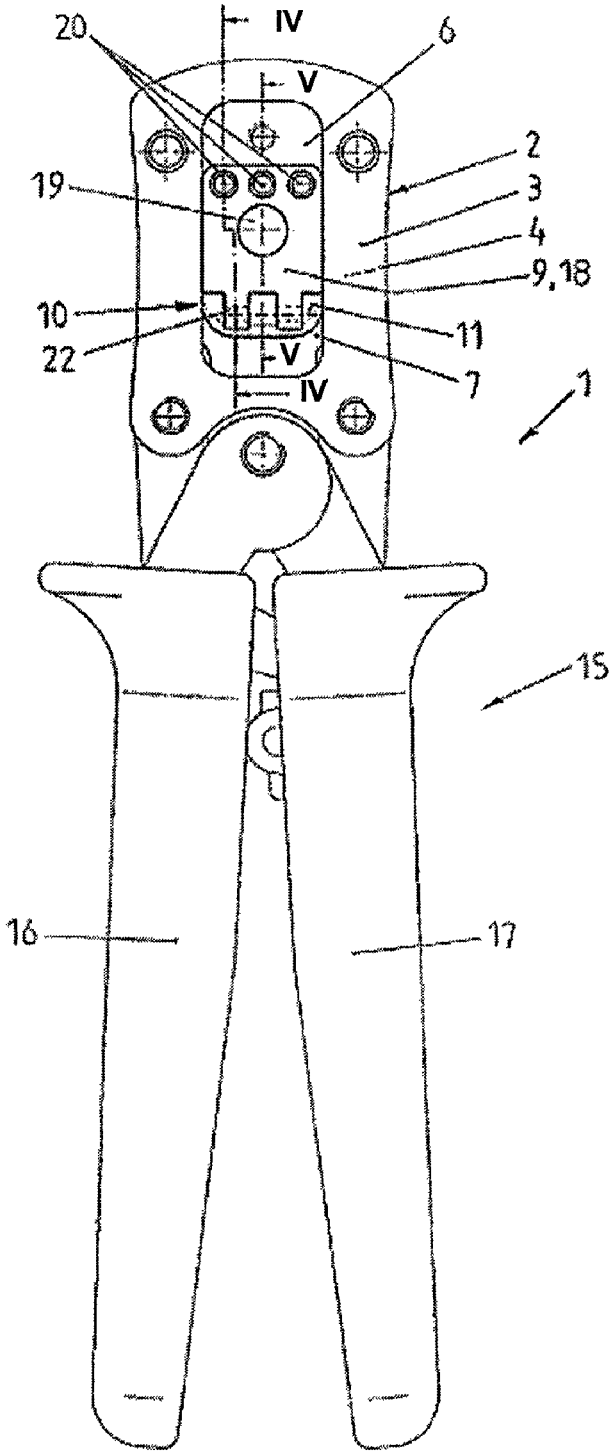
PRIOR ART Fig. 3
FIG. 3 shows crimping pliers known from DE 198 32 884 C1 having a ring-shaped closed head.

Referring now in greater detail to the drawings, FIG. 3 shows crimping pliers 1 having a ring-shaped closed head 2 built with plates, i.e., two cover plates 3 and 4 with identical shapes. The cover plates 3 and 4 are arranged symmetrically to the plane 5 (FIG. 4) of the head of the pliers. Plane 5 is defined by the two main directions of the extension of the head 2. In FIG. 3 the plate 5 corresponds to the drawing plane.

Figure 4:
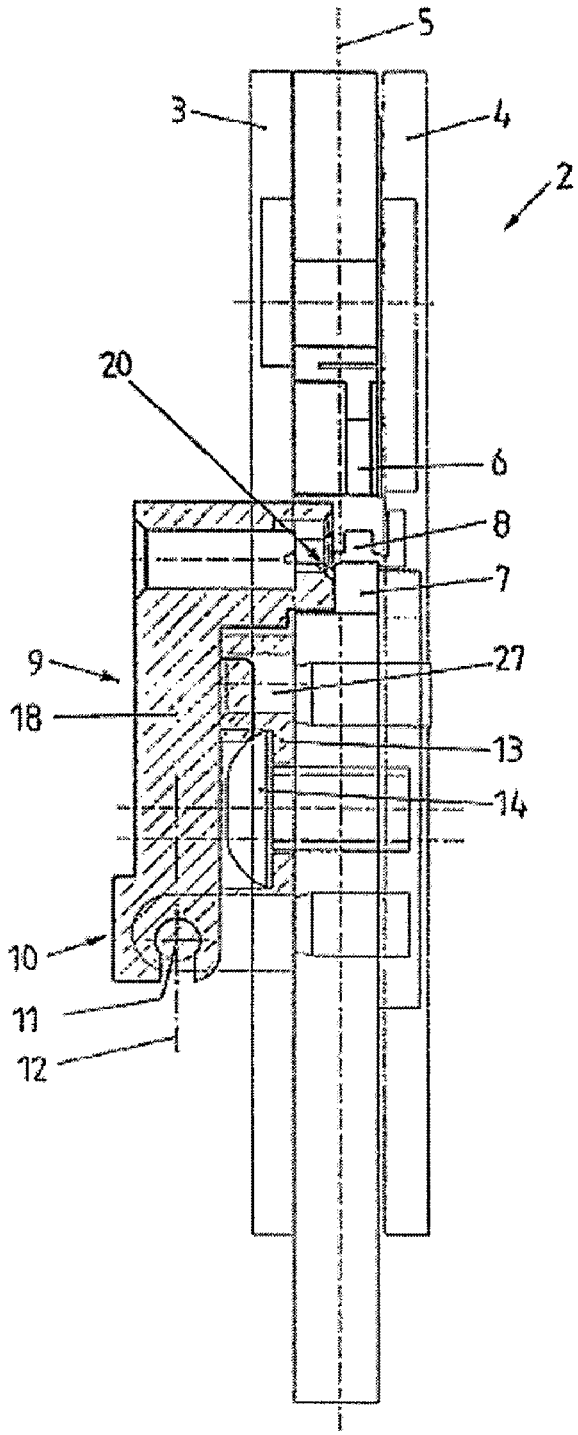
PRIOR ART Fig. 4
FIG. 4 shows a cross-section along section IV-IV in FIG. 3 through the head, wherein the sectional view shows a locator.

Two parts 6, 7 building a tool are located in the head 2. Part 6 is fixed at head 2, whereas part 7 is linked with the head 2 providing a degree of freedom for relative movement with respect to head 2. For the shown embodiment, the movable part 7 is guided along a linear path by means of the frame-like closed cover plates 3, 4. The parts 6, 7 might build a pair of dies used for plastically deforming a work piece 8 throughout a crimping process. Such deformation might be used for providing a crimping connection. Before starting the crimping process the work piece 8 has to be brought into a well defined relative position to the parts 6, 7. This is done by a locator 9 or positioner pivotably linked with the head 2 by a pivoting link 10 providing a pivoting movement around the pivoting axis 11. The pivoting link 10 is designed and arranged such that the pivoting axis 11 is located in a plane 12 having an orientation parallel to the plane 5 of the head of the pliers (FIG. 4). Usually plane 12 has some distance from the plane 5. However, it is also possible that planes 5, 12 are one and the same plane.

The locator 9 comprises a fixing plate 13. The fixing plate 13 is fixed by a screw at one part of head 2. Such part is connected both with the movable part 7 and with a drive 15. The drive 15 might be built with two hand levers 16, 17, wherein the hand levers are pivotably linked with each other at the head 2. The hand levers drive the movable part 7 linearly versus the fixed part 6.

The locator 9 also comprises a pivoting plate 18. The pivoting plate 18 is linked for a pivoting movement with the fixing plate 13 via a pivoting link 10. Accordingly, it is possible to pivot the pivoting plate 18 around the pivoting axis 11 (see FIGS. 7 and 8).

The pivoting plate 18 (FIG. 5) comprises at the side facing away from the plane 5 a protruding bolt 19 used for facilitating a gripping of the pivoting plate 18 when pivoting the pivoting plate 18 around the pivoting axis 11. On the other side facing the plane 5, the pivoting plate 18 comprises a nest 20. FIG. 3 shows three nests 20 located one besides the other at the locator 9 or the pivoting plate 18. The nests 20 correlate with three dies built at the parts 6, 7, whereas the different nests and dies are used for work pieces 8 having different diameters. Each nest 20 is built by a recess of the rear side 21 of the pivoting plate 18. However, it is also possible that the nest 20 of the locator 9 or the pivoting plate 18 is built by a protrusion, in particular a protruding pin for pinning up a sleeve-like or tube-like work piece 8.

Figure 5:
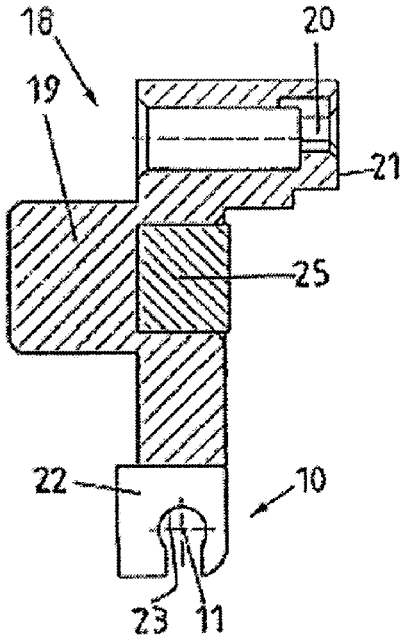
PRIOR ART Fig. 5
FIG. 5 is a sectional view of a pivoting plate of the locator along section V-V in FIG. 3.
Figure 6:
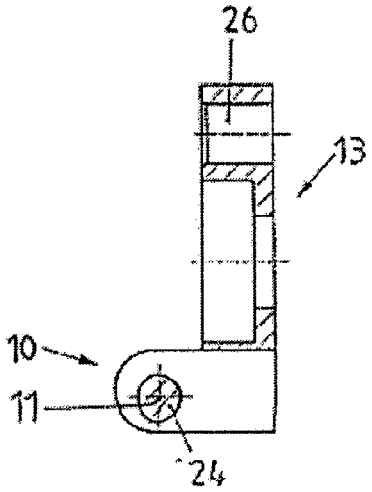
PRIOR ART Fig. 6
FIG. 6 is a sectional view of a fixing plate of the locator.

FIG. 5 is a sectional view of the pivoting plate 18 of the locator 9. The pivoting plate 18 might be manufactured by molding or die-forming and might be built from plastic or metal. The pivoting plate 18 in the lower region comprises a plurality of protrusions 22 having recesses 23 with an open cross-section for releasably pinning the pivoting plate 18 upon a bolt 24 linked with the fixing plate 13 (FIG. 6). In the assembled state the bolt 24 and the recess 23 with the open cross-section have a coaxial pivoting axis 11. A permanent magnet 25 is located in the lower part of the rear side 21 of the pivoting plate 18. The permanent magnet 25 is used for releasably securing a working position (see FIGS. 4 and 8). It is of advantage to release the secured working position of the pivoting plate 18 in case of the work piece 8 being dilated throughout the crimping process. Accordingly, it is possible that the pivoting plate 18 is slightly pivoted with a dilation of the work piece 8 throughout the crimping process, wherein the pivoting plate 18 does not apply large axial forces upon the work piece 8. The permanent magnet 25 providing a coupling force between the pivoting plate 18 and the fixing plate 13 might also be located at the fixing plate 13. Also the fixing plate 13 might be manufactured by molding or pressing from plastic or metal. A bore 26 might be provided engaging a pin 27 made of steel in the assembled state (FIG. 4), wherein the pin 27 cooperates with the permanent magnet 25. The pin 27 is additionally used for fixing the fixing plate 13 together with the screw 14 against a pivoting movement at the head 2. Instead of the use of a permanent magnet 25 (or additionally to such a permanent magnet 25) the pivoting plate 18 might be provided with one or a plurality of protrusions 28 at its rear side 21 that in the working position engage in, lock with or latching with bores of the fixing plates 18 (not shown in the figures). Such additional locking, latching or resting might be used for avoiding a play of the pivoting link 10 in the working position which might build up and increase when again and again using the locator 9. Furthermore, the locking, latching or resting serves for stabilizing the working position of the locator 9 or the pivoting plate 18 for introduced work piece 8.

Figure 7:
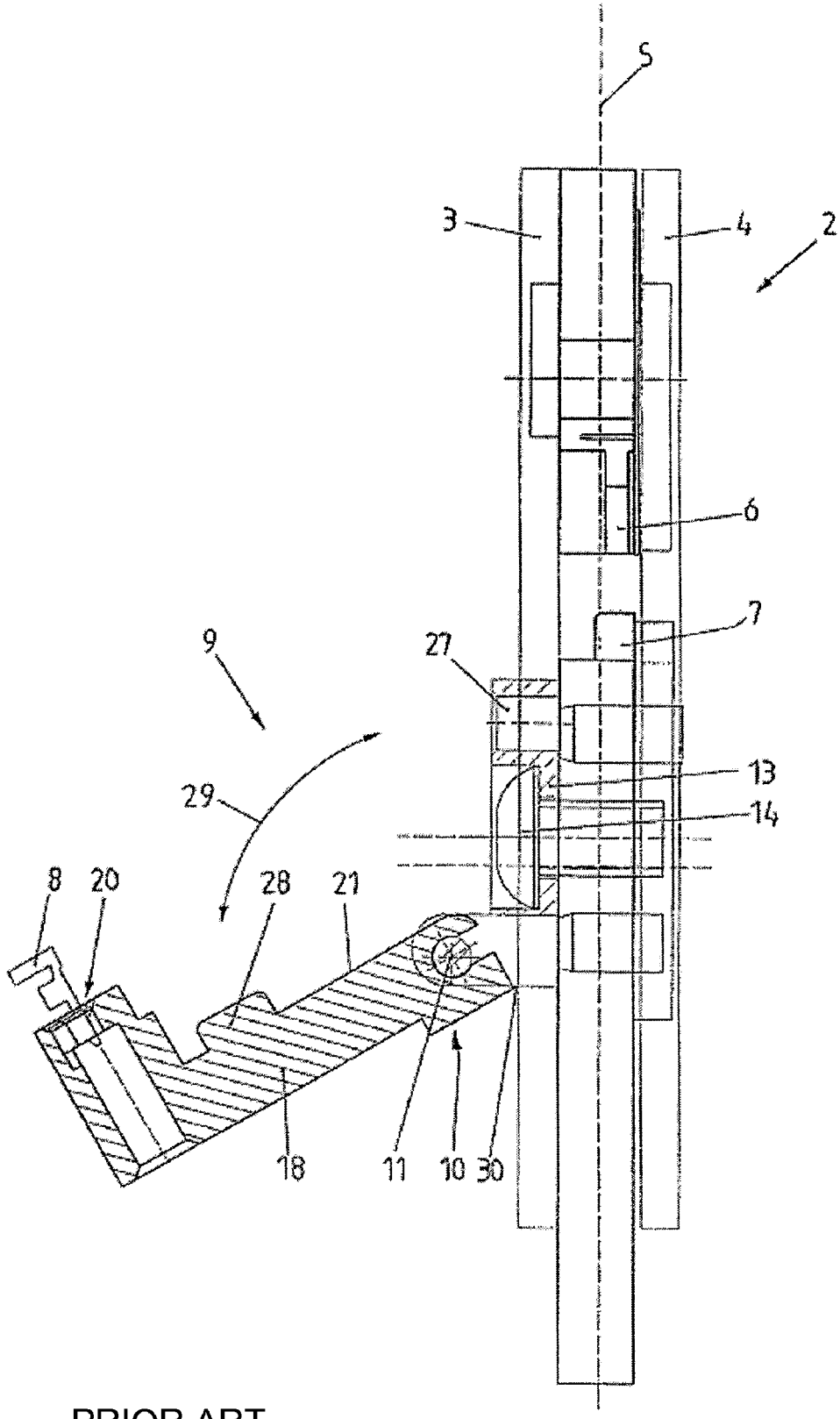
PRIOR ART Fig. 7
FIG. 7 is a view similar to FIG. 4 showing the pivoting plate in an open state for providing a position for assembly.

It is possible to pivot the pivoting plate 18 from a position for plugging on or for assembly (FIG. 7) into a working position (FIG. 8) with a pivoting angle 29 around the pivoting axis 11 of the pivoting link 10. The pivoting angle 29 should be equal to or larger than 75°. In particular the present invention suggests a pivoting angle 29 of more than 90°, e.g., approximately 120° as shown in FIG. 5. The pivoting angle 29 is limited by a stop element 30 which is built by cover plate 3. At the end of the pivoting movement (so in the position for assembly shown in FIG. 7) an outer region or edge of the pivoting plate 18 abuts the stop element 30. The stop element 30 at the same time builds a counter element for the pivoting plate 18 for fixing the pivoting plate 18 in the position for assembly (FIG. 7). In such position, the work piece 8 might be introduced at the exact position and orientation into a chosen nest 20.

The plugging on or introduction of the work piece 8 into the chosen nest 20 is done by hand, wherein the work piece 8 might be held between and guided by the thumb and the index finger. FIG. 7 shows a connector building the work piece 8. Such connector is used for building a crimping connection with an electrical wire. Usually an insulation of the electrical wire has been removed before starting the crimping process. Furthermore, it is possible to provide two separate crimping connections throughout one single crimping process, namely a crimping connection with the insulation of the electrical wire and another crimping connection of the connector with the metal core of the electrical wire.

Figure 8:
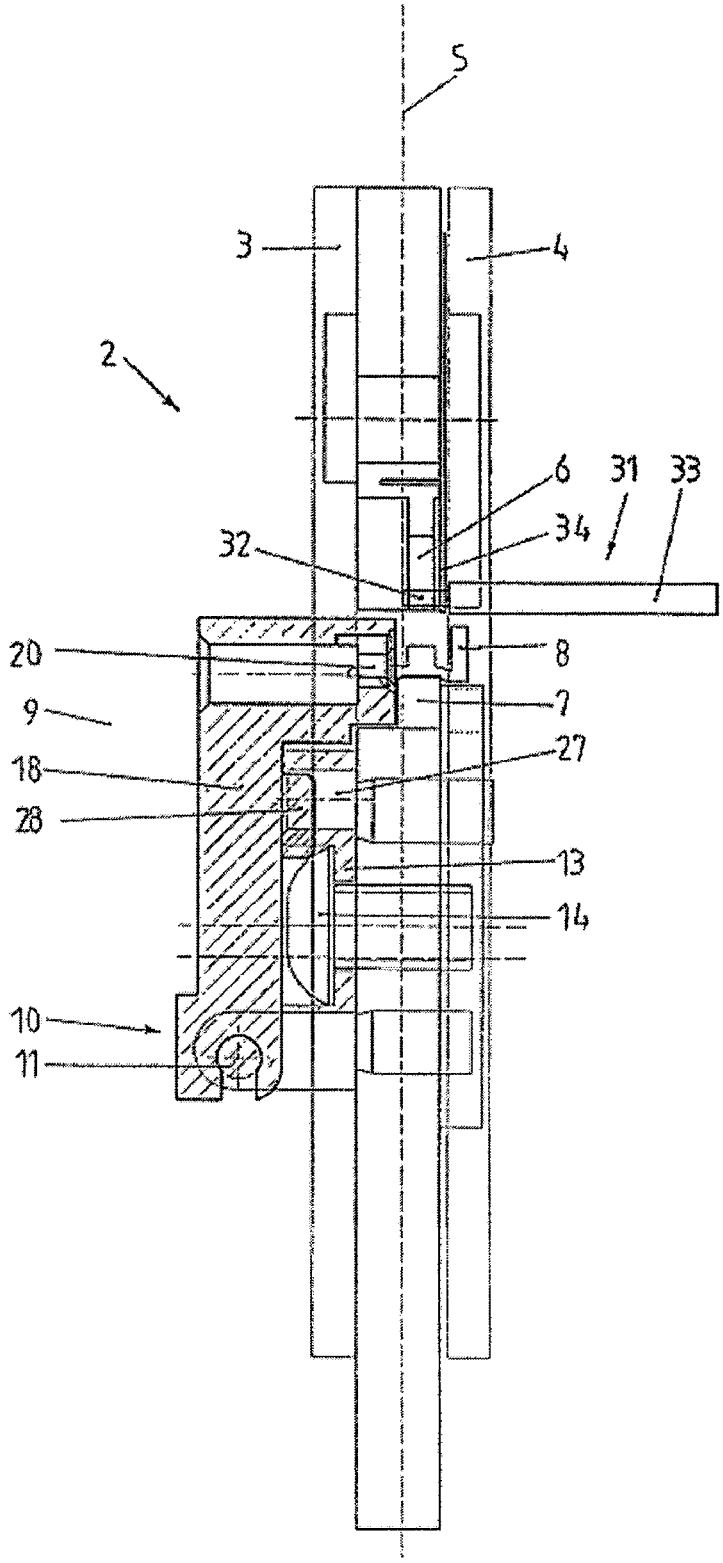
PRIOR ART Fig. 8
FIG. 8 is a view similar to FIGS. 4 and 7 showing the pivoting plate pivoted in a working position.
Figure 9:
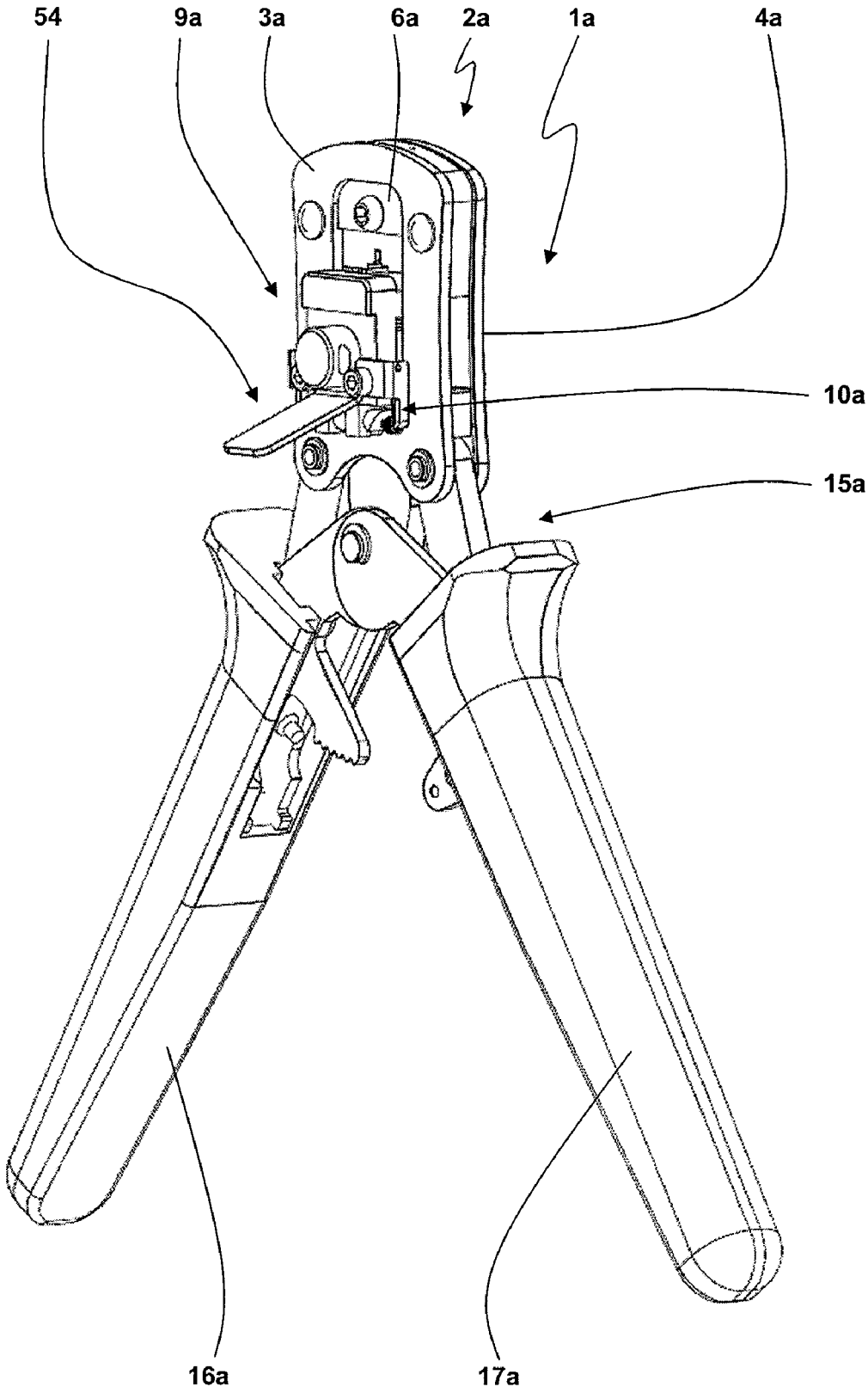
FIG. 9 is a three-dimensional view of crimping pliers according to the invention showing a pivotable locator having an arm in a working position.

FIG. 8 shows the positions of the relevant components at the start of a crimping process. The pivoting plate 18 of the locator has been pivoted with a pivoting angle 29 from the position for assembly according to FIG. 7 into the working position according to FIG. 8. The work piece 8, here a connector, has been positioned in the exact position relative to the movable part 7. The longitudinal axis of the work piece 8 and the axis of the movable part 7 are aligned with each other. As can be seen from FIGS. 7 and 8, the longitudinal axis of the work piece 8 is positioned from one side of the head 2 in an orientation perpendicular to the plane 5 in the working position. From the other side of the head 2 an electrical wire 31 with the insulation removed from the metal core 32 is introduced into the head 2 until the front surface of the insulation 33 abuts a stop element 34. The stop element 34 might be built by a thin plate being movable in the head 2 against the force of a spring. The stop element 34 serves for finding the predetermined position of the electrical wire in the head 2. However, the stop element 34 is without any interrelation with the positioning of work piece 8 in the head 2 in the working state. The position of the stop element 34 correlates with the position of the work piece 8 in the working position. As can be seen from FIG. 8, the axes of the work piece 8 or the nest 20 and the electrical wire 31 are parallel but have a distance from each other in an open state of the hand levers 16, 17. Throughout the crimping process, the movable part 7 with the locator 9 and the pivoting plate 18 is moved along a straight path in upper direction versus the fixed part 6. Accordingly, the side elements or cramps of the connector or work piece 8 are passed around the metal core 32 as well as around the insulation 33. Throughout the crimping process both of the aforementioned connections are closed. At the end of the crimping process, the electrical wire 31 is connected with the work piece 8. The wire 31 with the work piece 8 remains in the final relative position to the movable part 7 when opening the crimping pliers so that the unit built with the wire 31 and the work piece 8 might be removed from the crimping pliers in opposite direction to the direction used before for introducing the electrical wire 31. After returning the pivoting plate 18 of the locator 9 back into the position for plugging on or assembly according to FIG. 7 the next work piece 8 might be introduced and the crimping process might be repeated. The described embodiment according to FIGS. 3 to 8 (as well as other embodiments that might be combined with the features according to the invention) is disclosed in DE 198 32 884 C1.

FIGS. 9 to 12 show an embodiment of inventive crimping pliers, wherein components corresponding to the embodiment of FIGS. 3 to 7 are labeled with the same reference numerals but additional letters a.

Figure 13:
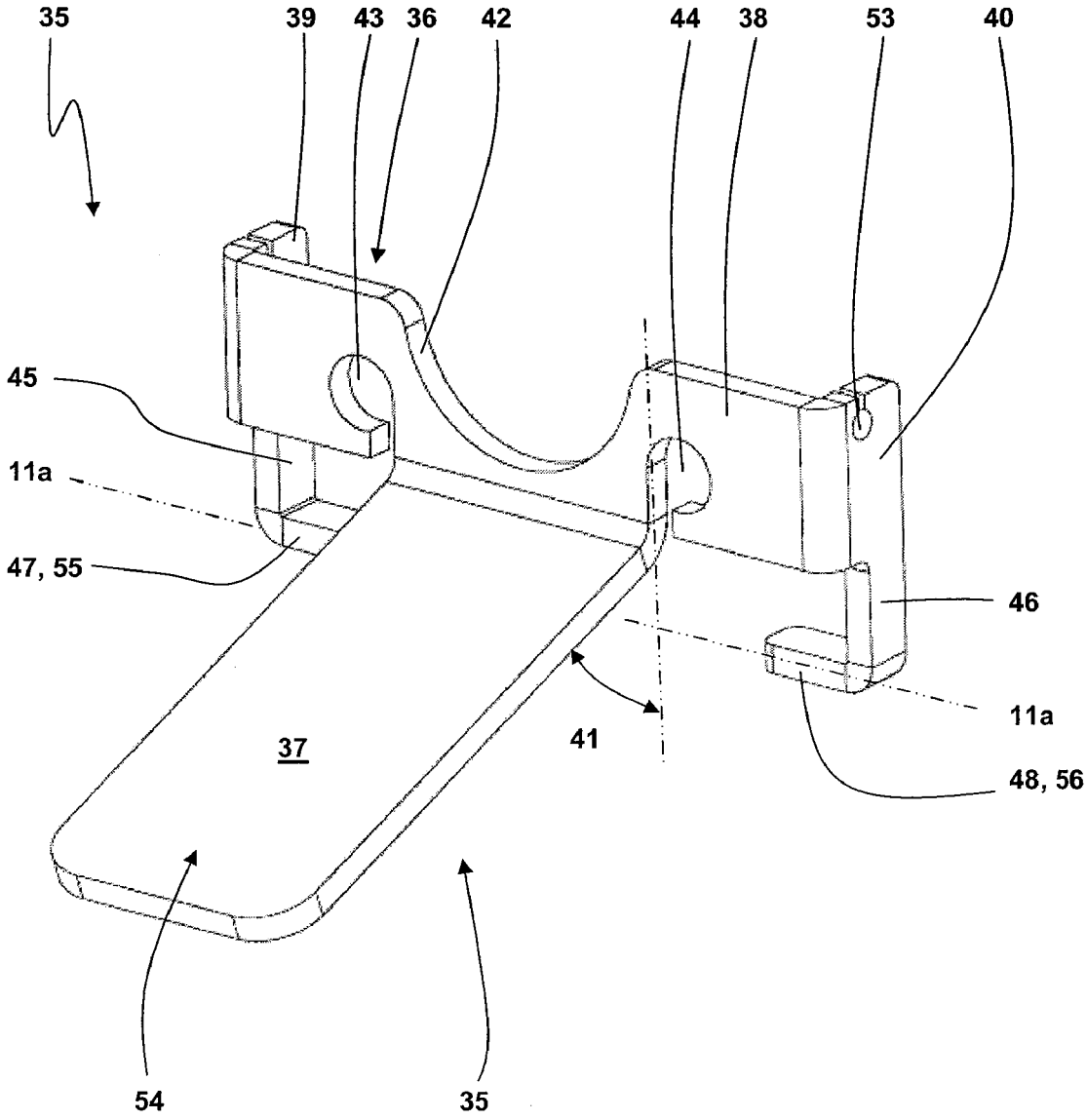
FIG. 13 is a three-dimensional view of an arm or extension appropriate for crimping pliers according to the invention.

For the inventive embodiment, the locator 9*a* comprises an extension or arm 35 which is shown as a single component in FIG. 13. For the shown embodiment, the arm 35 is built by a formed metal sheet having a constant thickness and building a bar or flap 37 extending from the connecting region 36. The bar or flap 37 is plain or flat with a U-shaped outer contour. The bar or flap 37 builds with the plane 5 an angle 41 smaller than 90°, wherein the angle 41 might be between 60° and 85°, in particular 70° to 80°, e.g. approximately 75°. The connecting region 36 is built by a band or bar having a constant width and being angled forming a U-shape with a base leg 38 and two parallel side legs 39, 40. The base leg 38 comprises an approximately half-circular recess 42 as well as two recesses 43, 44. The recesses 43, 44 might be opened or closed (see FIG. 12) in their cross-sections. The side legs 39, 40 have extensions in downward direction being built by rod-like protrusions 45, 46. The protrusions 45, 46 are angled towards each other by an angle of 90° in the end regions 47, 48 located opposite to the side legs 39, 40. In the assembled state, the end regions 47, 48 are aligned with the pivoting axis 11*a*-11*a*.

The arm 35 is brought into contact with the locator 9*a*, wherein the bolt 19 is introduced into the recess 42 coming into contact with the outer side of the locator at the rear side of the base leg 38. The side legs 39, 40 of the arm 35 laterally encompass the locator 9a. As can be seen from FIG. 10, the arm 35 is fixed at the locator 9*a* by screwing two screws 49, 50 through the recesses 43, 44 into screwed bores of the locator 9*a*. The end regions 47, 48 serve for holding a spring element 51, here a coiled spring or leg spring. The spring element 51 comprises two legs. These two legs are pivoted versus each other for producing a torsional moment of the spring element 51. A first leg 52 extends parallel to the protrusion 46 in upper direction and extends into a bore 53 in the side leg 40 for securing the arm 35 in the angled end region. The other leg of the spring element 51 is supported by the crimping pliers la (not shown), e.g. at the cover plate 3*a*, the fixing plate 13*a* or the head 2*a*. The spring element 51 is pre-stressed such that the spring element 51 biases the locator 9*a* with arm 35 versus the working position shown in FIG. 10 and secures the locator 9*a* and arm 35 in the working position. Additionally, the working position might be secured by means of the permanent magnet 25.

Figure 10:
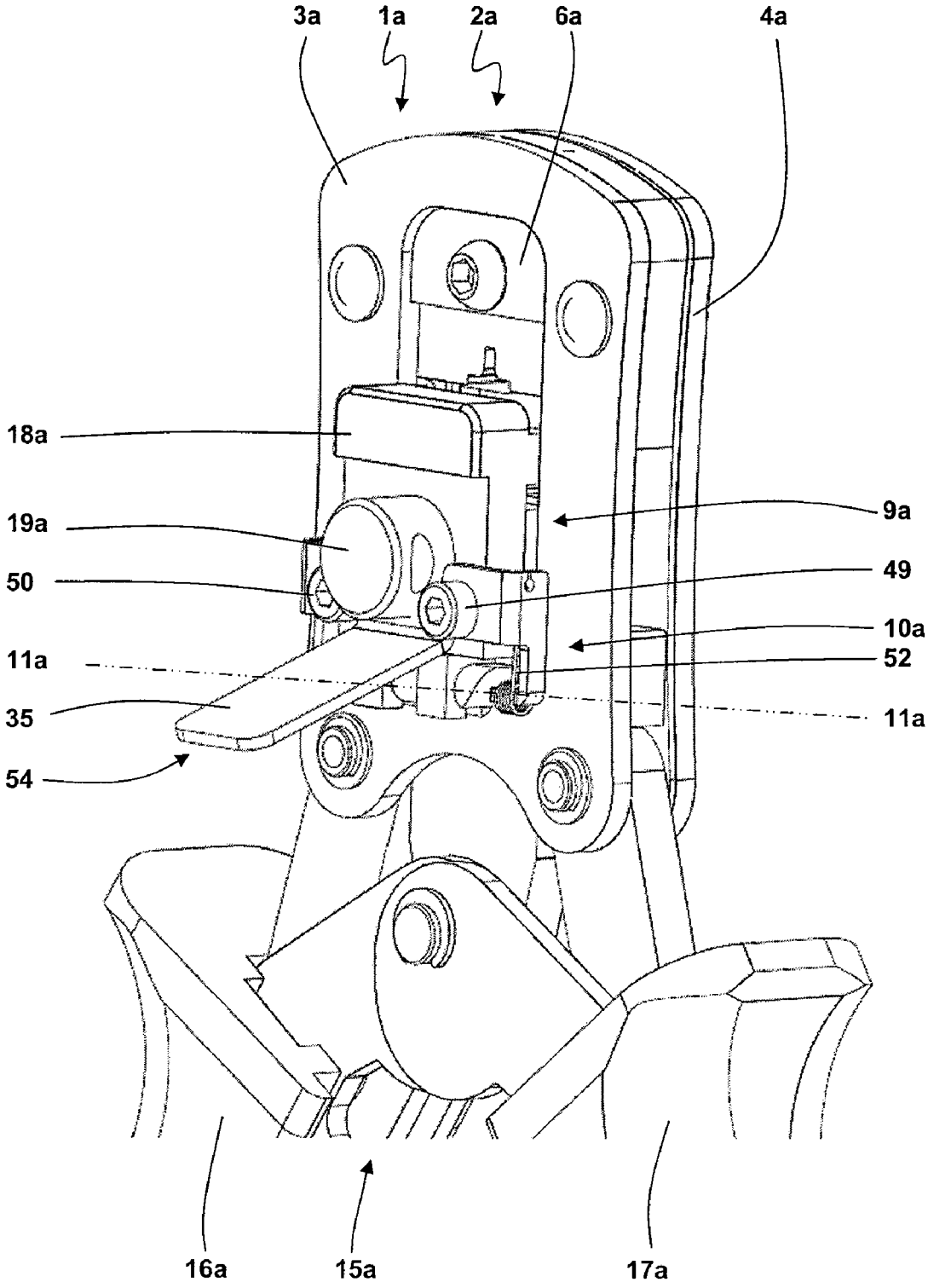
FIG. 10 is a view of the crimping pliers of FIG. 9 with a scale enlarged with respect to FIG. 9.
Figure 11:
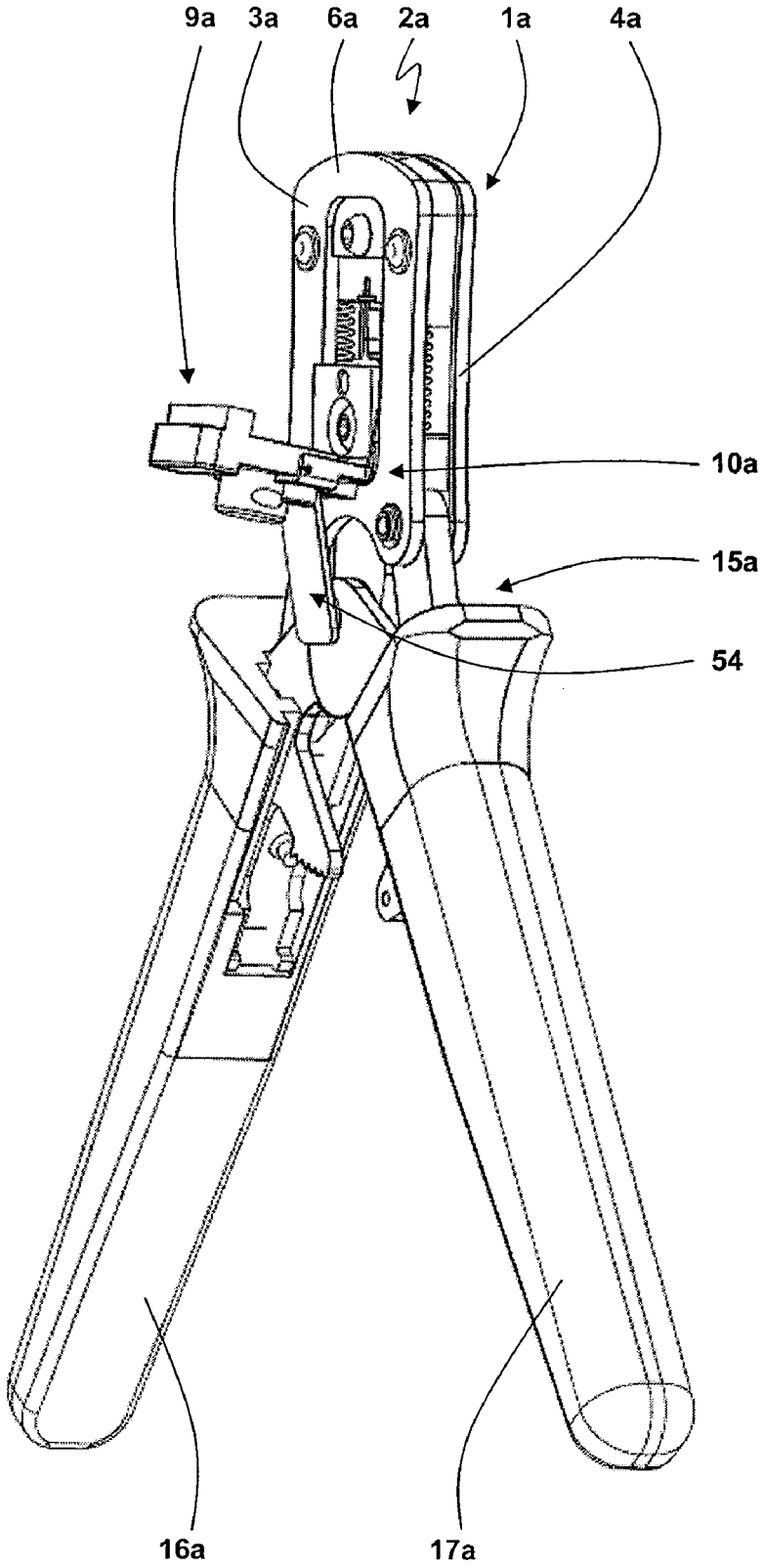
FIG. 11 is a three-dimensional view of the crimping pliers according to FIGS. 9 and 10 in a position for assembly.
Figure 12:
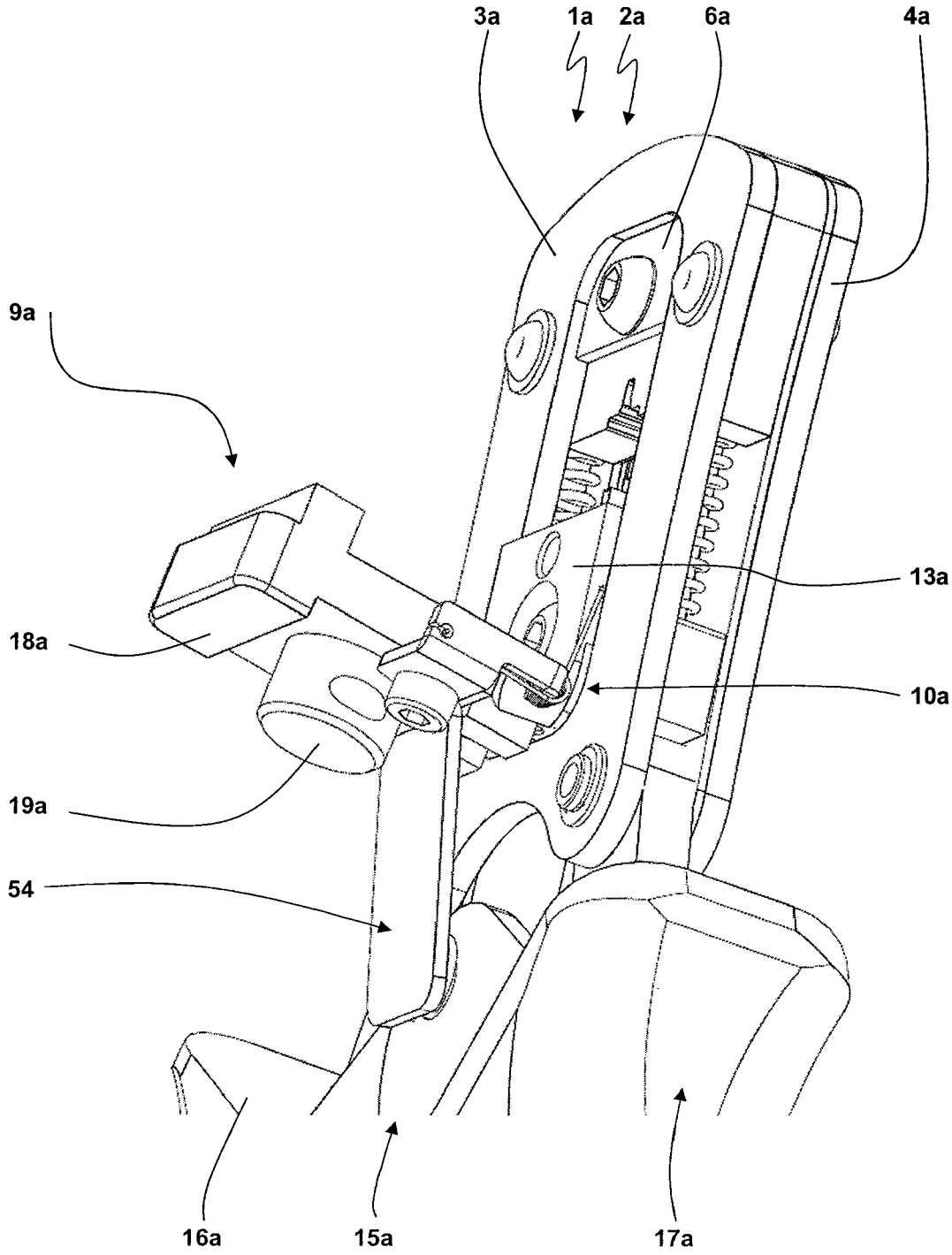
FIG. 12 is a view according to FIG. 11 with an enlarged scale.

As shown in FIG. 10, the bar or flap builds an angle between approximately 60° to 80°, e.g., 70° to 80°, in particular approximately 75° with the plane 5*a*, wherein the bar or flap 37 is slightly inclined versus the hand levers 16*a*, 17*a*. A user when gripping or contacting the hand levers 16*a*, 17*a* with a hand is able to apply an activation force upon the bar or flap 37 with a finger, in particular the index finger or middle finger. The finger applies such force from the outer side in inner direction versus the head 2. Accordingly, the bar or flap 37 might be used with a one-hand operation as an activating element 54 by the user. By one-hand operation the user is able to apply a force and a moment upon the locator 9*a* for pivoting the locator 9*a* from the working position according to FIG. 9 into a position for plugging on or for assembly according to FIG. 11. When reducing or removing the activating force applied by the user, the spring element 51 closes the locator 9*a* by pivoting the locator 9*a* back into the working position. The pivoting movement might be limited for determining the position for plugging on or for assembly (differing from the embodiment shown in FIGS. 3 to 7) by a contact of the bar or flap 37 with another element of the crimping pliers 1*a*, e.g., a part of the drive unit 17 or the pivoting bolt of the drive unit 17. The end regions 47, 48 build supports 55, 56 for the spring element 51.

Many variations and modifications may be made to the preferred embodiments of the invention without departing substantially from the spirit and principles of the invention. All such modifications and variations are intended to be included herein within the scope of the present invention, as defined by the following claims.

We claim:

1. Crimping pliers for crimping a work piece, comprising:

two hand levers, said hand levers having a relative degree of freedom and being linked with dies for applying a crimping movement, wherein the hand levers comprise a pivoting joint with a pivoting axis for pivoting said hand levers in a first plane, in a working position of a locator an arm builds an angle smaller than 90° with said first plane, and said locator is linked with a head for said arm being pivoted versus said first plane for transferring the locator from the working position into a position for assembly, wherein said arm has a dimension, position and orientation such that a pivoting movement of said locator is limited by said arm abutting another component of said crimping pliers, said head housing the dies, and said locator having a pivoting degree of freedom with respect to said head around the pivoting axis, said pivoting axis having an orientation parallel to a main extensional plane of said head and transverse to the degree of freedom of said dies during the crimping process, said locator having an activating element, said activating element being designed and arranged for an activation by the hand of a user for directly or indirectly causing the pivoting movement of said locator, said activating element having an extension being designed and arranged such that said extension is located in the access area of a finger of a hand of a user of said pliers gripping or contacting said hand levers, wherein said extension is built with the arm of said locator.

2. The crimping pliers of claim 1, wherein said arm is built by a metal sheet.

3. The crimping pliers of claim 1, wherein said arm builds a support for a spring element.

4. The crimping pliers of claim 2, wherein said arm builds a support for a spring element.

5. The crimping pliers of claim 4, wherein said arm made of a metal sheet comprises at least one protrusion building a supporting axis for a spring element.

6. The crimping pliers of claim 1, wherein said locator is biased by a spring element versus the working position.

7. The crimping pliers of claim 1, wherein said locator is secured in a working position by a latching mechanism.

8. The crimping pliers of claim 1, wherein said activating element is designed and arranged such that the activating element might be activated by a right hand of a user of the crimping pliers gripping said hand levers as well as a left hand of the user of said crimping pliers gripping said hand levers.

* * * * *